US006645409B2

(12) United States Patent
Feilmair et al.

(10) Patent No.: US 6,645,409 B2
(45) Date of Patent: Nov. 11, 2003

(54) PROCESS FOR THE PRODUCTION OF CELLULOSIC FIBRES

(75) Inventors: Wilhelm Feilmair, Seewalchen (AT); Heinrich Firgo, Vöcklabruck (AT); Johann Männer, Weyregg (AT)

(73) Assignee: Lenzing Aktiengesellschaft, Lenzing (AT)

( * ) Notice: Subject to any disclaimer, the term of this patent is extended or adjusted under 35 U.S.C. 154(b) by 291 days.

(21) Appl. No.: 09/814,152

(22) Filed: Mar. 21, 2001

(65) Prior Publication Data

US 2002/0008331 A1 Jan. 24, 2002

Related U.S. Application Data

(63) Continuation of application No. PCT/AT99/00229, filed on Sep. 28, 1999.

(30) Foreign Application Priority Data

Sep. 29, 1998 (AT) ..... 1614/98

(51) Int. Cl.[7] ..... D01D 5/06; D01F 2/02

(52) U.S. Cl. ..... 264/145; 264/187; 264/203; 264/211.14; 264/233

(58) Field of Search ..... 264/145, 187, 264/203, 211.14, 233

(56) References Cited

U.S. PATENT DOCUMENTS

| | | | | |
|---|---|---|---|---|
| 4,246,221 | A | 1/1981 | McCorsley, III | 264/203 |
| 4,790,044 | A | 12/1988 | Kirchner et al. | 8/151 |
| 5,409,532 | A | 4/1995 | Astegger et al. | 106/200.2 |
| 5,589,125 | A | 12/1996 | Zikeli et al. | 264/187 |
| 6,103,162 | A | 8/2000 | Frigge et al. | 264/187 |

FOREIGN PATENT DOCUMENTS

| | | | |
|---|---|---|---|
| DE | 19600572 | A1 | 7/1997 |
| EP | 0218934 | A2 | 4/1987 |
| EP | 0553070 | B1 | 7/1993 |
| WO | 92/14871 | A1 | 9/1992 |
| WO | 93/19230 | A1 | 9/1993 |
| WO | 96/05340 | A1 | 2/1996 |
| WO | 97/14829 | A1 | 4/1997 |
| WO | 97/25462 | A1 | 7/1997 |
| WO | 97/45574 | A1 | 12/1997 |
| WO | 98/02602 | A1 | 1/1998 |
| WO | 98/03707 | A1 | 1/1998 |

OTHER PUBLICATIONS

English translation of WO 97/14829 (Apr. 24, 1997).

*Primary Examiner*—Leo B. Tentoni
(74) *Attorney, Agent, or Firm*—Baker Botts L.L.P.

(57) ABSTRACT

The invention relates to a process for the production of cellulosic fibers from solutions of cellulose in an aqueous tertiary amine oxide whereby the extruded fibers are led through a precipitating bath and cut and the cut fibers are passed through a series of water baths in the form of a fleece and then dried, whereby the wash baths are connected to each other and fresh washing liquor is applied to the last wash bath and led in countercurrent with the transportation direction of the fibre fleece to the first wash bath. The process in accordance with the invention is characterised in that the pH value of each of these wash baths is maintained higher than 8.5.

13 Claims, No Drawings

PROCESS FOR THE PRODUCTION OF CELLULOSIC FIBRES

CROSS-REFERENCE TO RELATED APPLICATIONS

This is a continuation of application Serial No. PCT/AT99/00229 filed Sep. 28, 1999, which is incorporated by reference herein. PCT/AT99/00229 was not published in English.

This invention relates to a process for the production of cellulo sic fibres from solutions of cellulose in an aqueous tertiary amine oxide.

In the last few decades intensive efforts were undertaken to make alternative and more environmentally friendly processes available for the production of cellulosic fibres as a result of the environmental problems associated with the well-known viscose process. One interesting possibility to emerge in the last couple of years was to dissolve cellulose in an organic solvent without the formation of a derivative and to extrude moulded bodies from this solution. Fibres spun from solutions of this kind were also allocated the generic name of Lyocell by BISFA (The International Bureau for the Standardisation of Man-Made Fibres) whereby a mixture of an organic chemical and water is understood by an organic solvent. Moreover, fibres of this kind are also known by the term of "solvent-spun fibres".

It has been found that a mixture of tertiary amine oxide and water is particularly well suited as the organic solvent for the production of Lyocell fibres and respectively other moulded bodies. In this respect mainly N-methylmorpholine-N-oxide (NNMO) is used as the amine oxide. Other suitable amine oxides are disclosed in EP-A 0 553 070. Processes for the production of cellulosic elongate members from a solution of cellulose in a mixture of NNMO and water are for example disclosed in U.S. Pat. No. 4,246,221 or in PCT-WO 93/19230. In this process the cellulose is extruded through a spinneret, stretched in an air gap and precipitated from the solution in an aqueous precipitating bath. In the following this process is described as the "amine oxide process" or "Lyocell process" whereby in the following abbreviation "NNMO" means all tertiary amine oxides which can dissolve cellulose. Fibres produced according to the same amine oxide process are characterised by their high fibre tenacity in the conditioned and wet state, high wet modulus and high loop strength.

From PCT-WO 97/14829 it is known that after leaving the precipitating bath freshly spun Lyocell fibres are cut and washed in the form of a fleece of irregularly oriented fibres.

PCT-WO 92/14871 describes a process to wash fibres produced according to the amine oxide process. In this process the continuous and as yet uncut fibres are passed through a series of water baths in the form of a tow. The cutting of the fibres to staple fibres takes place at a later stage in the process.

PCT-WO 92/14871 emphasises that the pH value of the wash baths has to be below 8.5 otherwise the fibres produced have a greater tendency to fibrillation.

In this connection PCT-WO 92/14871 points out that it is known from the viscose process for the production of cellulosic fibres that one of the washing stages is designed as a bleaching stage in which an alkaline pH value predominates. In the amine oxide process, however, it is known that all of the washing liquors to recover NMMO are recirculated. In this connection it is also known from PCT-WO 92/14871 that the wash baths are connected one to the other and fresh washing liquor is applied to the last wash bath and led in countercurrent with the transportation direction of the fibre tow to the first wash bath. Since the entry of large quantities of additional chemicals to this circuit is not desired, no bleaching stage can be implemented in the amine oxide process into the circuit of the washing liquor. It is only possible to provide a bleaching bath independent of the wash baths connected one to the other. If in the following "washing baths" are mentioned then an independent bleaching bath of this kind is not meant.

Another problem with washing fibres produced according to the amine oxide process is that any NMMO sticking to the fibres has to be completely removed from these.

SUMMARY OF THE INVENTION

The present invention sets itself the task of making a process available in which the NMMO can be washed out of the fibre with a minimum amount of effort.

This task is resolved by a process for the production of cellulosic fibres from solutions of cellulose in an aqueous tertiary amine oxide whereby the extruded fibres are led through a precipitating bath and cut and the cut fibres are passed in the form of a fleece through several wash baths and finally dried whereby the washing baths are connected one to the other and fresh washing liquor is applied to the last wash bath and led in countercurrent with the transportation direction of the fibre fleece to the first wash bath and whereby the process is characterized in that the pH value of each of the wash baths is maintained higher than 8.5. For the purpose of the present invention, a pH value of more than 8.5 is termed an "alkaline pH value" in the following.

DETAILED DESCRIPTION OF THE INVENTION

The invention relates to so-called "washing lines" of a series of wash baths connected to each other. In accordance with the invention, the pH value of the washing liquor of each of the wash baths connected to each other has to be maintained higher than 8.5. Baths which are not connected to the wash baths and are, therefore, not fed with the same washing liquor, such as separate treatment and bleaching baths, are not covered by the present invention.

Surprisingly it has been shown that an alkaline pH value in the wash baths in the case of washing freshly spun and cut Lyocell fibres in the form of a fleece, in contrast to washing continuous fibres in tow form, has the effect that the NMMO can be completely removed from the fibre in a few washing steps. In this way the need for washing water and installations can be clearly reduced which has a positive impact on the cost of the process.

Moreover in contrast to washing the fibres in tow form it is seen that an alkaline pH value of the wash bath(s) has no negative impact on the tendency to fibrillation of the fibres produced.

One advantageous embodiment of the process in accordance with the invention is characterised in that the pH value of the wash baths is maintained between 9 and 11. Moreover, the pH value of the wash baths is preferably maintained between 10 and 11.

It appears that the greatest amount of NMMO is removed from the fibres when washing the NMMO out of the fibres in the first wash baths. In the wash baths which follow only very low amounts of NMMO are still present in the fibres which are, however, more difficult to wash out. If the wash liquor has an alkaline pH value this results in an increase in the rate at which NMMO is washed out particularly in the baths which follow.

In one advantageous form of the invention the pH value in the wash baths can be set by adding alkaline buffering substances. In this respect the addition of sodium hydroxide is given preference. The amount of sodium hydroxide required in this respect, which depends on process parameters such as the pH value of the fleece respectively the humidity in the fleece, can be easily ascertained by the expert in the circumstances given. In a simple way the amount added is regulated by the pH value of the wash baths.

The sodium hydroxide can be added to only one of the wash baths or in several places of the washing procedure. It has been shown that the addition of alkali to the wash baths does not have a negative influence on the process steps which follow such as the cleaning of the wash baths and the recovery of the solvent.

In particular it is an advantage to add the alkaline buffering substance in the second third of the washing line which comprises the wash baths connected one to the other. This guarantees that in the final wash baths, in which an alkaline pH value plays a particularly important role, there is sufficient alkalinity and that, on the other hand, not too much alkaline buffering substance is discharged with the washed fibres.

Moreover it is advantageous that liquor is forced out of the fibre fleece after it leaves the wash bath before entering the following wash bath. Thereby it can be prevented to a large extent that NMMO-containing wash waters are trailed into the following washing stage.

The temperature of the wash water is preferably between approximately 20° C. to 90° C.

To wash the fleece this can be led through the wash baths filled with washing liquor. The washing baths can also be designed so that the washing liquor is sprayed onto the fleece.

The overall liquor ratio of washing liquor to fibre fleece preferably equals 1.5:1 to 40:1.

The invention is described in greater detail in the following embodiments.

A process to wash a fibre fleece from freshly spun cut Lyocell fibres is described as follows:

The fibre fleece is thereby conveyed e.g. on a screen belt through different wash baths. In each wash bath the fibre fleece is sprayed with wash liquor from above from a vessel located below the screen belt. The wash liquor flows downwards back into the respective vessel. Fresh wash water is fed to the last bath. The wash water circulates in the respective baths whereby the rate of circulation within one bath can be higher than the rate of supply of fresh wash water into the last wach bath. Excess wash water is led in countercurrent with the transportation direction of the fibre fleece to the respective upstream wash bath. Liquor is forced out of the fibre fleece by means of pairs of rollers following each wash bath. After leaving the last wash bath, the washed fibre fleece is led to other post-treatment stages and respectively dried. The wash water from the first wash bath is further led to the precipitating bath respectively to NMMO purification and recovery.

EXAMPLE 1 (COMPARATIVE EXAMPLE)

In a continuously working pilot plant a fibre fleece of freshly spun Lyocell fibres was washed in five wash baths using slightly alkaline water as a washing liquor without any additional measures, in accordance with the general process mode indicated above.

Following each wash bath the fleece was squeezed to a water content of approximately 200%. After the final wash bath the fleece was squeezed to a water content of approximately 100% and then the fleece was dried.

EXAMPLE 2 (PROCESS ACCORDING TO THE INVENTION)

The procedure was the same as in example 1, however, within the course of the fourth wash bath 0.1 M NaOH was added which resulted in a pH value of approximately 11 in the inlet of the third wash bath.

In both trials the extent of NMMO washed out in each wash bath was determined. This is defined by discharge factor f which is ascertained in accordance with the following formula:

$$f=(c_1-c_2)/c_1,$$

whereby $c_1$ is the concentration of NMMO on the fibre when entering the wash bath and $c_2$ is the concentration of NMMO on the fibre when leaving the wash bath. A higher value for discharge factor f signifies that NMMO is washed out more completely in the respective wash bath.

In the table which follows the pH values measured in the wash baths, and the discharge factors, are compared one with the other:

| | Comparative example | | Process in accordance with the invention | |
|---|---|---|---|---|
| Wash bath | PH value | Discharge factor f | PH value | Discharge factor f |
| 1 | 7,6 | 0,7 | 10,4 | 0,8 |
| 2 | 7,1 | 0,5 | 10,8 | 0,6 |
| 3 | 7,3 | 0,5 | 11,1 | 0,6 |
| 4 | 7,3 | 0,5 | 11,3 | 0,6 |
| 5 | 8,2 | 0,4 | 9,7 | 0,9 |

A comparison of these figures shows that with the process according to the invention the NMMO content of the fibres within one wash bath can be lowered to a larger extent. This is particularly true of the last wash baths in which the removal of the low residual amount of NMMO is particularly difficult. With the process according to the invention it is, therefore, possible to completely remove the NMMO with significantly fewer wash baths and thus at less expense.

What is claimed is:

1. A process for the production of cellulosic fibres from solutions of cellulose in an aqueous tertiary amine oxide comprising (i) extruding cellulosic fibres; (ii) leading the fibres through a precipitating bath; (iii) cutting the fibres to form a fleece; (iv) passing the fleece through a series of wash baths, wherein (a) the wash baths are connected one to the other, (b) fresh washing liquor is applied to the last wash bath and led in countercurrent with the transportation direction of the fleece; and (c) the pH value of each of said wash baths is maintained higher than 8.5; and (v) drying the washed fleece.

2. The process according to claim 1 wherein the pH value of each of the wash baths is maintained between 9 and 11.

3. The process according to either claim 1 or 2 wherein the pH value in the wash baths is set by adding alkaline buffering substances.

4. The process according to claim 3 wherein sodium hydroxide is added to at least one of the wash baths.

5. The process according to claim 1 wherein liquor is forced out of the fibre fleece after the fleece leaves the wash bath and before the fleece enters the following wash bath.

6. The process of claim 1 wherein the temperature of the washing liquor equals 20° C. to 90° C.

7. The process according to claim 2 wherein liquor is forced out of the fibre fleece after the fleece leaves the wash bath and before the fleece enters the following wash bath.

8. The process according to claim 3 wherein liquor is forced out of the fibre fleece after the fleece leaves the wash bath and before the fleece enters the following wash bath.

9. The process according to claim 4 wherein liquor is forced out of the fibre fleece after the fleece leaves the wash bath and before the fleece enters the following wash bath.

10. The process of claim 2 wherein the temperature of the washing liquor equals 20° C. to 90° C.

11. The process of claim 3 wherein the temperature of the washing liquor equals 20° C. to 90° C.

12. The process of claim 4 wherein the temperature of the washing liquor equals 20° C. to 90° C.

13. The process of claim 5 wherein the temperature of the washing liquor equals 20° C. to 90° C.

* * * * *